US005742697A

United States Patent [19]

Ching-Chung

[11] Patent Number: 5,742,697

[45] Date of Patent: Apr. 21, 1998

[54] MICROPHONE WITH TELESCOPIC SOUND PICKUP MEANS

[75] Inventor: Chiang Ching-Chung, Taipei Hsien, Taiwan

[73] Assignee: PAO Sung Industrial Co., Ltd., Taipei, Taiwan

[21] Appl. No.: 558,514

[22] Filed: Nov. 16, 1995

[51] Int. Cl.[6] ..... H04R 25/00

[52] U.S. Cl. ..... 381/169; 381/168

[58] Field of Search ..... 381/168, 169, 381/87, 88, 91, 111, 112, 113, 114, 115, 122, 188, 205, 26

[56] References Cited

U.S. PATENT DOCUMENTS 681,813 9/1901 Ries ..... 381/169

2,288,822 7/1942 McCarron ..... 381/169

4,060,697 11/1977 Neal ..... 381/169

5,406,638 4/1995 Hirschhorn ..... 381/168

*Primary Examiner*—Sinh Tran

*Attorney, Agent, or Firm*—Donald C. Casey

[57] ABSTRACT

A microphone having a telescopic sound pickup means includes a handle fitted with an adjusting knob provided with an internal spiral slide groove. By turning the adjusting knob, a pin may be brought by the spiral slide groove to slide upwardly and downwardly along a vertical slot formed in one side of the handle. The pickup head is therefore brought to perform telescopic actions by the displacement of the pin.

2 Claims, 7 Drawing Sheets

MICROPHONE WITH TELESCOPIC SOUND PICKUP MEANS

BACKGROUND OF THE INVENTION

1. Field of the Invention

The present invention relates to a microphone, and more particularly to a hand-held microphone with a telescopic sound pickup means.

2. Description of the Prior Art

Conventional hand-held microphones have fixed internal components, and the pickup effects of the microphone are directly affected by the distance from the sound source to the head of the microphone. In singing or speaking, when a user holds the microphone at quite a distance from his/her mouth or if his/her voice is too low, the pickup effects of the microphone will be poor. It is therefore necessary for the user to hold the microphone near to his/her mouth, which may make the user quite uncomfortable since he/she may not used to holding the microphone near the mouth.

SUMMARY OF THE INVENTION

A primary object of the present invention is to provide a microphone with a sound pickup means capable of telescopic actions, in which an adjusting knob provided on a handle may be turned to cause the sound pickup means to displace upwardly or downwardly to ensure good pickup effects.

BRIEF DESCRIPTION OF THE DRAWINGS

The foregoing and other features and advantages of the present invention will be more clearly understood from the following detailed description and the accompanying drawings, in which.

FIG. 3A-2 is a top view of the microphone of FIGS. 3A-1;

FIG. 3B-1 is another fragmentary side view of the microphone of this invention showing the adjusting knob in phantom;

FIG. 3B-2 is a top view of the microphone of FIG. 3B-1;

DETAILED DESCRIPTION OF THE PREFERRED EMBODIMENT

Figure 1:
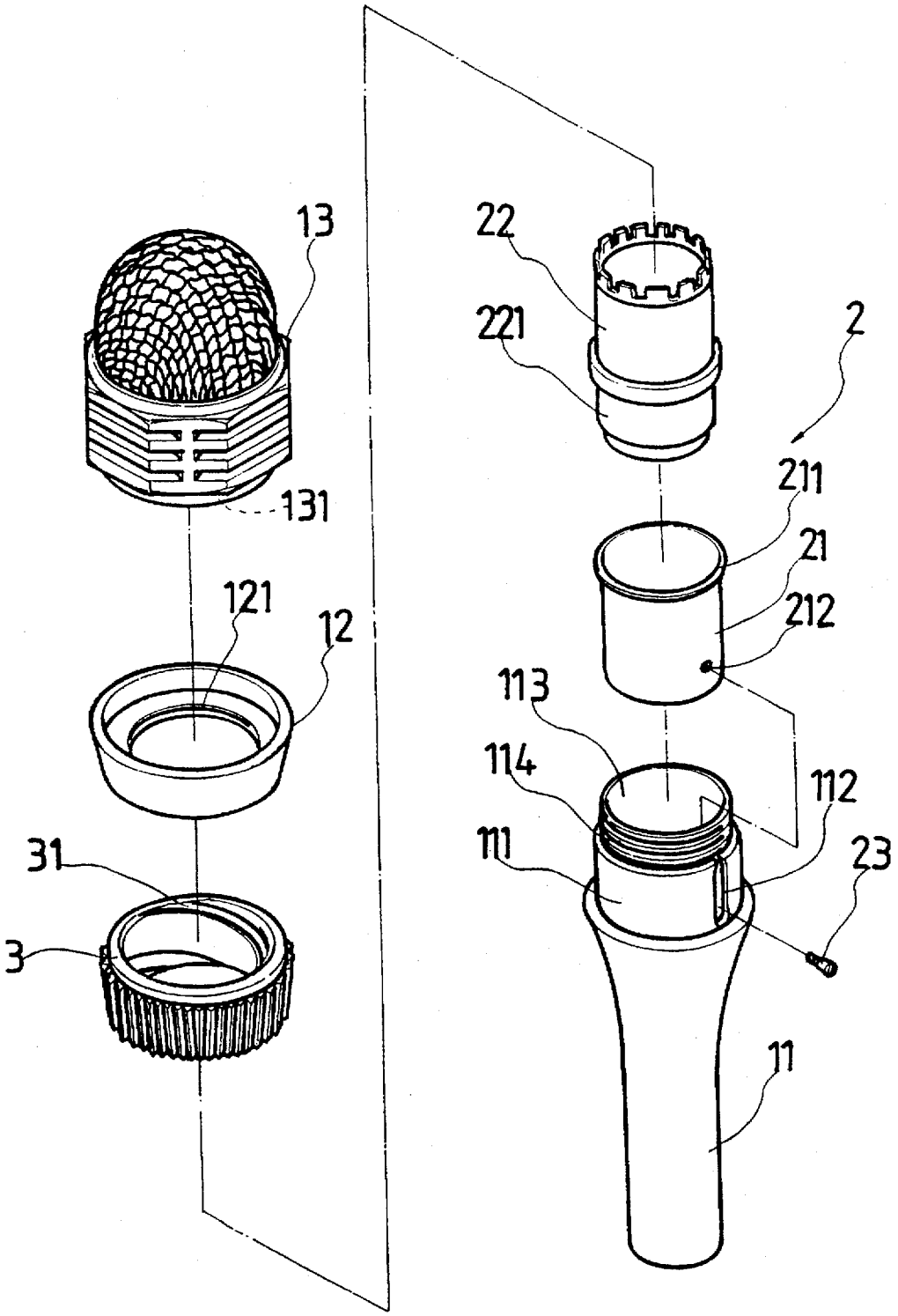
FIG. 1 is an exploded view of a preferred embodiment of the microphone according to the present invention.
Figure 4:
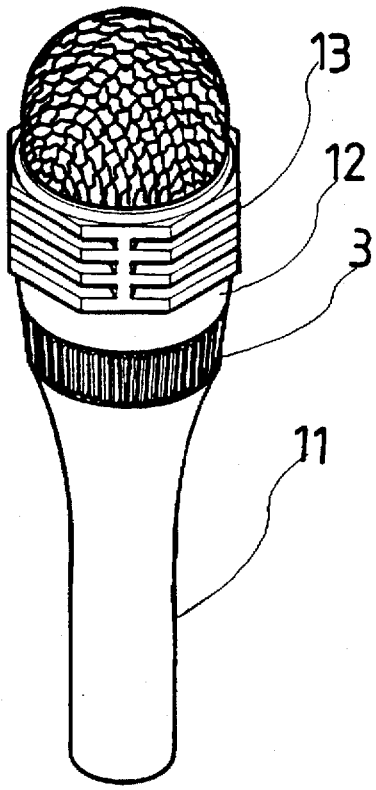
FIG. 4 is an outer view of the microphone according to the present invention in an assembled state.

With reference to FIGS. 1 and 4, a preferred embodiment of the present invention basically comprises a hollow handle 11, a sound pickup means 2 fitted into the hollow of the handle 11, an adjusting knob 3 fitted onto the handle 11 for adjusting the height of the sound pickup means 2 inside the handle 11, a ring 12 locked onto the handle 11 for limiting the movement of the adjusting knob 3, and a cap 13 located above the ring 12.

Figure 2:
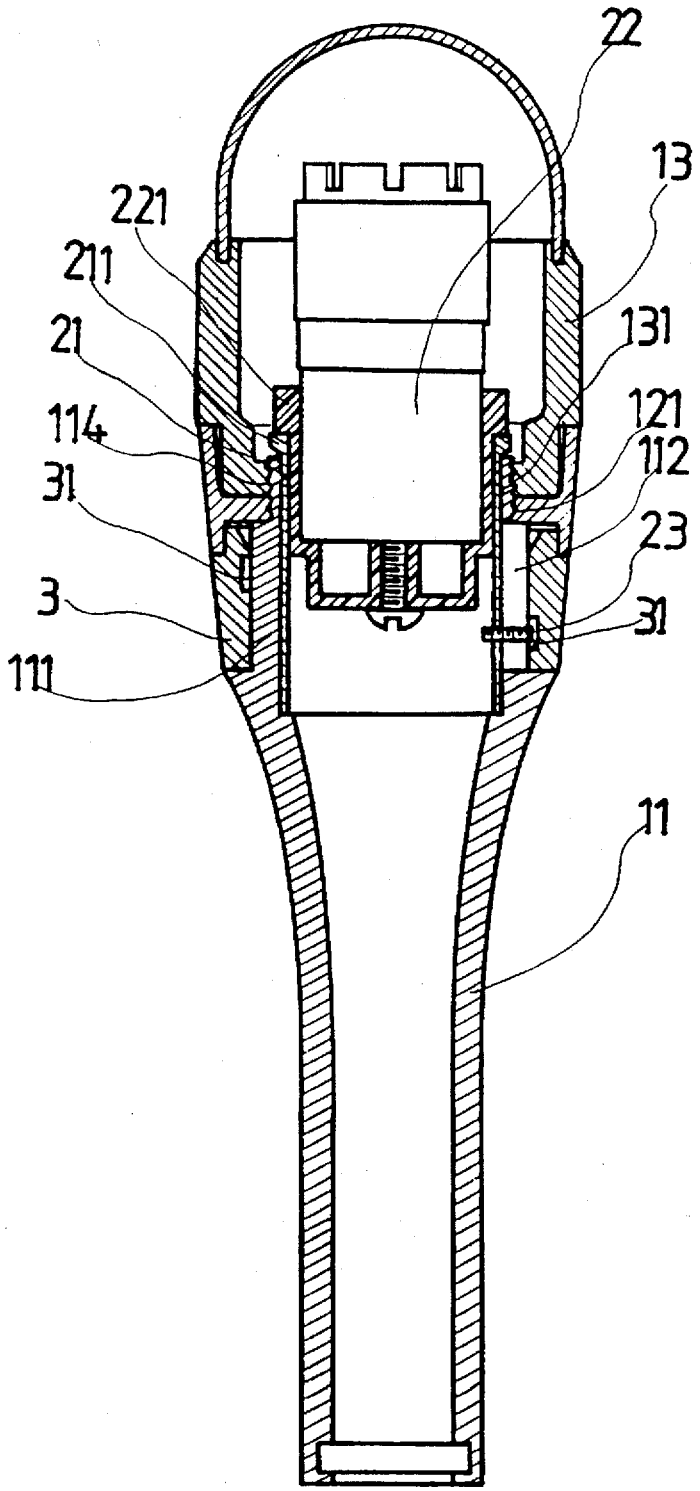
FIG. 2 is a sectional view of the microphone according to the present invention in an assembled state; fragmentary side view of the microphone of the present invention with the adjusting knob shown in phantom.

FIG. 2 illustrates the inter-relationship among the above-mentioned components of the microphone structure according to the present invention. The handle 11 has a stair-shaped shaft 111 at an upper portion thereof for receiving the adjusting knob 3 which turns thereon. The shaft 111 is provided with a vertical slot 112 in one side thereof and a slide seat 113 at a top end thereof for receiving a hollow movable sleeve 21 of the sound pickup means 2 and for slidable movement thereon. The slide seat 113 has external threads 114 for securing the ring 12 and the cap 13.

The sound pickup means 2 consists of a head 22 which is fitted into the movable sleeve 21 by means of a soft pad 221 at the bottom side thereof. The movable sleeve 21 is provided with a flange 211 at its apical end and a screw hole 212 near the bottom end thereof. When the movable sleeve 21 of the sound pickup means 2 is slipped into the slide seat, a pin 23 may be used to pass through the slot 112 to be locked within the screw hole 212 so that the sound pickup means 2 may be secured on the handle 11 and may slidably displace upwardly and downwardly inside the slide seat 113.

The adjusting knob 3 is an annular structure with vertical corrugations on its outer circumferential surface. The inner wall of the adjusting knob 3 is configured to have a spiral slide groove 31 along which the pin 23 may slide to enable the adjusting knob 3 to be screwably fitted onto the shaft 111. The ring 12 has an inner projecting ring which is provided with internal threads 121. By means of the internal threads 121 which engage with the external threads 114 of the handle 11, the ring 12 is capable of restraining the displacement of the adjusting knob 3 due to the counter-action of the pin 23. The cap 13 is a polygonal hollow structure with a spherical mesh top. Internal threads 131 are provided at a bottom portion of the cap 13 for engaging the external threads 113 of the handle 11 and thereby coupling with the ring 12. The cap 13 is provided to protect the internal structure of the microphone of the present invention.

Figures 2, 3A:
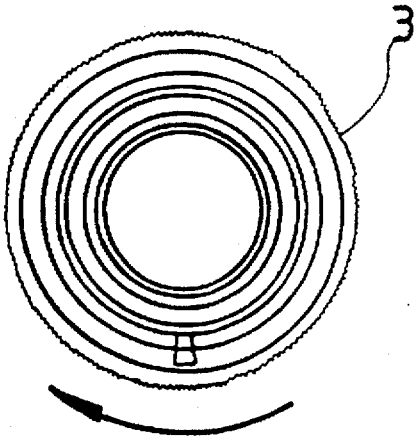
Figures 1, 3A:
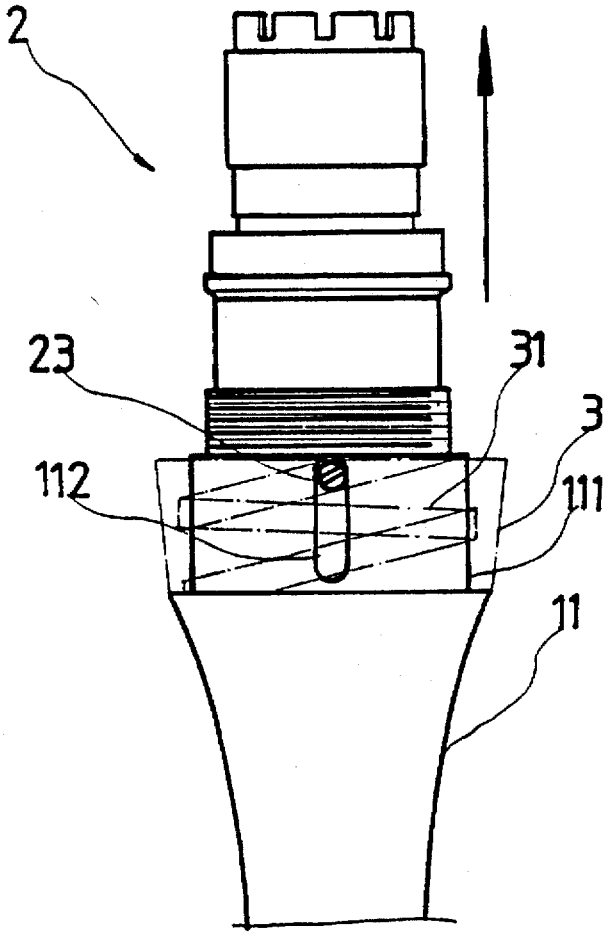
Figures 2, 3B:
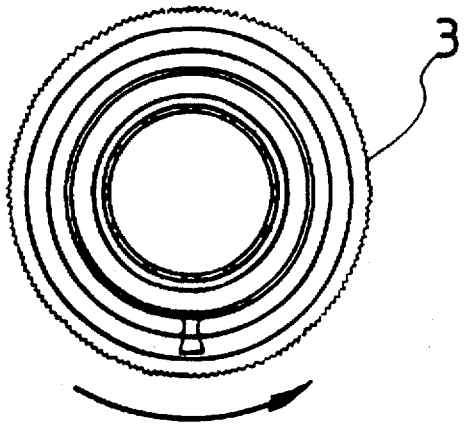
Figures 1, 3B:
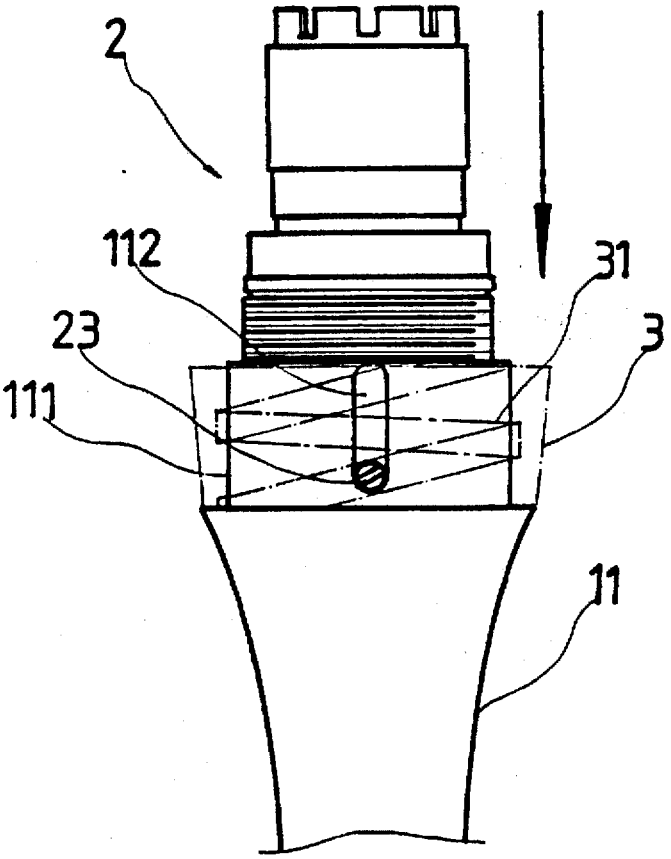

FIGS. 3A-1 through 3B-2 illustrate the telescopic actions of the sound pickup means 2 of the microphone according to the present invention. As shown in FIG. 3A-1, when the user turns the adjusting knob 3 in a clockwise direction, the pin 23 disposed in the slot 112 will be pushed upwardly along the spiral groove 31 of the adjusting knob 3, so that the sound pickup means 2 projects in the direction of the upper portion of the handle 11. As shown in FIG. 3B-1, when the user turns the adjusting knob 3 in a counter-clockwise direction, the pin 23 disposed in the slot 112 will be pushed downwardly along the spiral groove 31 of the adjusting knob 3 so that the sound pickup means 2 retracts in the direction of the lower portion of the handle 11.

Figure 5:
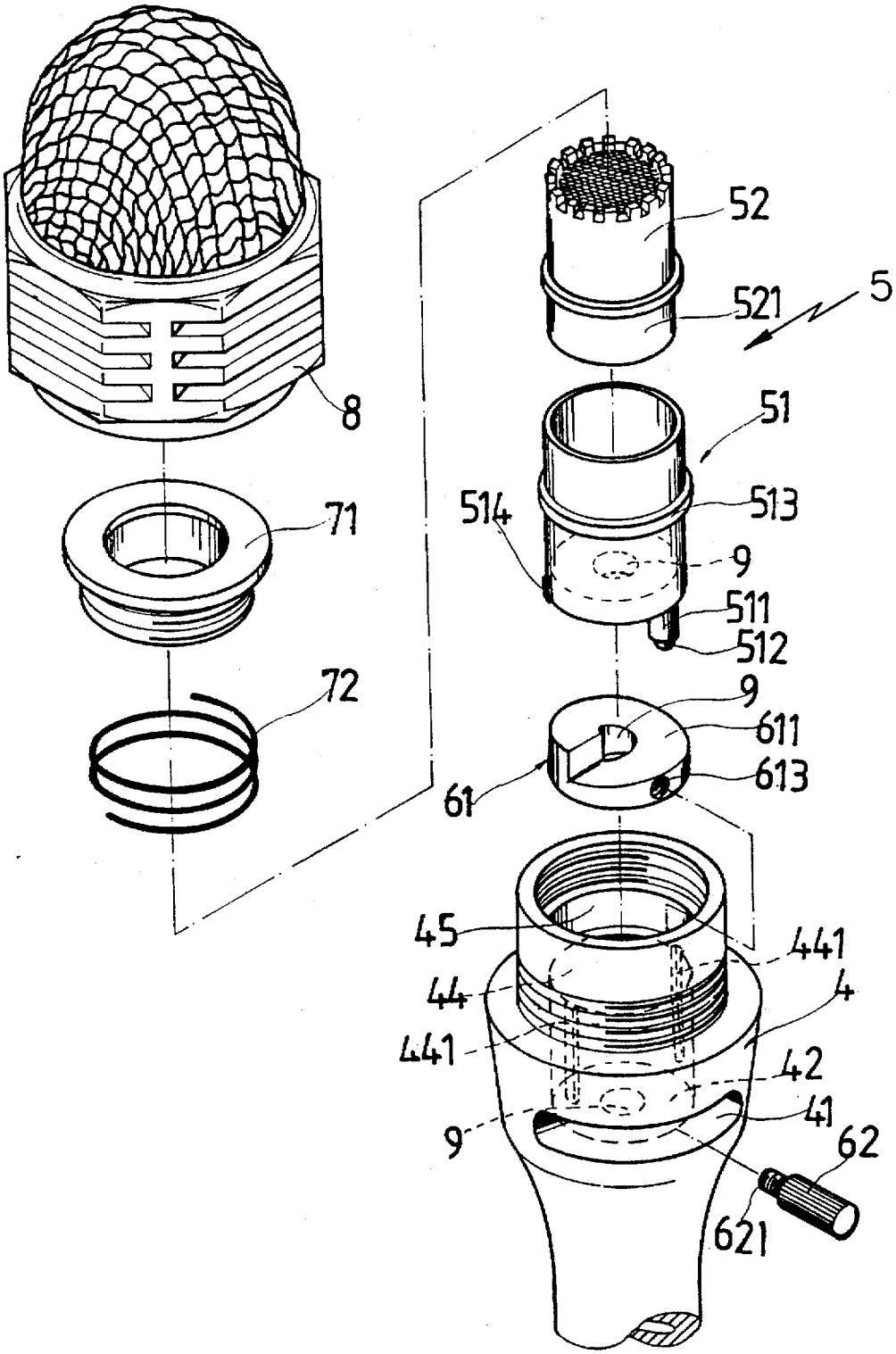
FIG. 5 is an exploded view of a microphone of another embodiment of the present invention.
Figure 6:
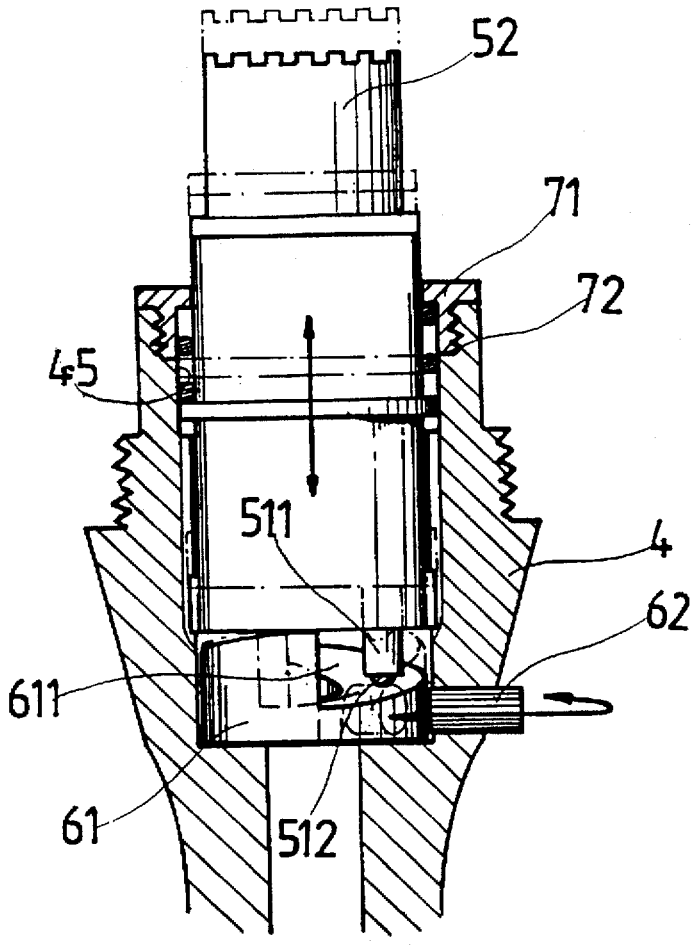
FIG. 6 is a sectional view of the microphone shown in FIG. 5.

FIG. 5 shows another preferred embodiment of the microphone with telescopic sound pickup means which comprises a spiral block 61 with a spiral upper surface 611 which rises from a lower position to a higher position to create a difference in height in the upper surface, so that the sound pickup means 5 may slidably displace upwardly and downwardly along the spiral upper surface 611. With further reference to FIG. 6, a handle 4 has an interior provided with a first hollow 44 and a second hollow 45 of different diameters. A bottom side of the first hollow 44 forms a substantially planar support 42 for receiving the spiral block 61 which may turn clockwisely or counter-clockwisely thereon. The first hollow 44 is further provided with two slide rails 441 disposed on opposite sides thereof at suitable positions for receiving two lugs 514 formed on the outer periphery of a bottom portion of a movable sleeve 51. The movable sleeve 51 is hence located above the spiral block 61 in the first hollow 44 such that a steel ball 512 on a rod 511 at a bottom side of the movable sleeve 51 is in contact with the spiral upper surface 611. When the spiral block 61 is turned, the movable sleeve 51 is therefore caused to slidably displace upwardly and downwardly. The movable sleeve 51 is further provided with a projecting ring 513 on an outer surface at a middle section thereof. A spring 72 is fitted above the projecting ring 513 on the outer surface of the movable sleeve 51. Besides, a ring 71 is fitted around the spring 72 for restricting the spring 72 on an inner wall of the second hollow 45 so that the spring 72 may exert pressure on the movable sleeve 51 which may keep contact with the spiral upper surface 611 to a certain extent for ensuring the downward displacement of the movable sleeve 51 along the spiral supper surface 611. Furthermore, a central hole 9 is formed in the movable sleeve 51, the spiral block 61 and the handle 4 respectively through which an electrical wire of a sound pickup head 52 of the movable sleeve 51 may pass. The first hollow 44 of the handle 4 is additionally provided with a horizontal slot 41 at a suitable position in a bottom portion thereof such that a trigger lever 62 may pass through the slot 41 to be locked onto one side of the spiral block 61. When the trigger lever 61 is turned to displace horizontally within the slot 41, the spiral block 61 may be caused to displace clockwisely or counter-clockwisely, pushing the movable sleeve 51 thereabove to slidably displace upwardly and downwardly on the spiral upper surface 611, achieving the telescopic effect of the sound pickup means 5.

Although the present invention has been illustrated and described with reference to the preferred embodiment thereof, it should be understood that it is in no way limited to the details of such embodiment but is capable of numerous modifications within the scope of the appended claims.

What is claimed is:

1. A microphone with telescopic sound pickup means, said microphone comprising:

a hollow handle having a stair-shaped shaft at an upper portion thereof, said shaft having a vertical slot in one side thereof, said handle further having a vertical slide seat with external threads at an apical end thereof;

a pickup means consisting of a pickup head which is disposed within a hollow movable sleeve by means of a soft pad provided at a bottom side thereof, said movable sleeve having a flange at an apical end thereof and a screw hole near a bottom end thereof, a pin being provided to pass through said slot in said handle to be locked in said screw hole so that said movable sleeve may be fitted into said slide seat of said handle and may displace upwardly and downwardly therein;

an adjusting knob being an annular ring provided with external vertical corrugations and having a spiral slide groove provided at an inner wall thereof, said pin being capable of sliding along said groove to enable said adjusting knob to be screwably fitted onto said shaft of said handle; and a ring having an inner projecting ring provided with internal threads, whereby said ring may be locked onto the external threads of said slide seat to restrict displacement of said adjusting knob by means of counteractions of said pin.

2. A microphone with telescopic sound pickup means comprising:

a handle, and a spiral block having a spiral upper surface, a movable sleeve for supporting a sound pickup head of the sound pickup means, a spring for resetting said movable sleeve, and a ring for restraining said spring fitted respectively into an interior of said handle, said handle having a horizontal slot formed in one side thereof with a trigger lever passing through said slot to be locked onto said spiral block, said movable sleeve having a rod projecting from a bottom side thereof for contacting said spiral upper surface of said spiral block, wherein when said trigger lever is turned to reciprocate within said slot in said handle, said spiral block is caused to displace clockwisely or counter-clockwisely, which in turn causes said movable sleeve to slidably displace upwardly and downwardly along said spiral upper surface to enable said sound pickup means to perform telescopic actions.

* * * * *